US009884221B2

(12) United States Patent
McJames, II

(10) Patent No.: US 9,884,221 B2
(45) Date of Patent: Feb. 6, 2018

(54) EXERCISE BENCH WITH ENHANCEMENTS THAT ALLOW THE OBESE, ELDERLY, AND PHYSICALLY CHALLENGED TO PARTICIPATE IN EXERCISES PERFORMED ON A CONVENTIONAL EXERCISE BENCH

(71) Applicant: William Charles McJames, II, Hillsborough, NJ (US)

(72) Inventor: William Charles McJames, II, Hillsborough, NJ (US)

(73) Assignee: HEALTHY U PERSONAL TRAINING, INC., Whitehouse Station, NJ (US)

( * ) Notice: Subject to any disclaimer, the term of this patent is extended or adjusted under 35 U.S.C. 154(b) by 0 days.

(21) Appl. No.: 15/068,596

(22) Filed: Mar. 13, 2016

(65) Prior Publication Data

US 2017/0259109 A1 Sep. 14, 2017

(51) Int. Cl.
*A63B 26/00* (2006.01)
*A63B 21/00* (2006.01)
*A63B 22/00* (2006.01)

(52) U.S. Cl.
CPC ..... *A63B 21/4029* (2015.10); *A63B 22/0015* (2013.01)

(58) Field of Classification Search
CPC . A63B 21/008–21/0089; A63B 21/158; A63B 21/4029; A63B 21/40; A63B 21/4031; A63B 21/4027; A63B 22/0015–22/0017
USPC ..... 482/92–94, 104, 106–108, 111–113, 482/140–142, 145
See application file for complete search history.

(56) References Cited

U.S. PATENT DOCUMENTS 4,098,502 A 7/1978 Faust
4,353,547 A 10/1982 Jenkinson
4,397,462 A * 8/1983 Wilmarth ..... A63B 21/0087 482/113
4,407,495 A 10/1983 Wilson
4,546,967 A 10/1985 Kecala
4,635,934 A 1/1987 Roethke
(Continued)

*Primary Examiner* — Stephen R Crow
*Assistant Examiner* — Garrett Atkinson

(57) ABSTRACT

An exercise bench that allows elderly, obese, and physically challenged individuals to participate in the same exercise regimens as younger, more agile athletes is provided. The exercise bench of the current invention comprises cushioned side supports that stabilize the individual during reclining and during exercise. Due to the nature of the exercises performed in the prone position, an exercise bench is generally narrow in order to allow freedom of movement for the Individual's arms. The narrow bench can provide stability challenges for elderly and obese individuals which the side support cushions address by providing the required stability without interfering with the individual's range of arm motion for exercising. The present invention also includes mechanical means to assist the user in reclining to a prone position, and returning to an upright sitting position. Many individuals who want to use a conventional exercise bench are prohibited from doing so because they lack the abdominal strength to lie down slowly from a sitting position, and return to a sitting position after exercising without assistance. The exercise bench of the current invention overcomes these obstacles.

7 Claims, 5 Drawing Sheets

(56) References Cited

U.S. PATENT DOCUMENTS 4,653,751 A 3/1987 Green
4,765,616 A 8/1988 Wolff
4,830,363 A * 5/1989 Kennedy ..... A63B 21/4033 434/254
4,848,739 A * 7/1989 Schaub ..... A63B 21/00072 482/113
4,861,025 A * 8/1989 Rockwell ..... A63B 21/0616 108/167
4,974,839 A 12/1990 Cantor
5,060,939 A 10/1991 Oswald et al.
5,125,884 A 1/1992 Weber et al.
5,125,881 A * 6/1992 Jones ..... A63B 21/0615 482/100
5,141,480 A * 8/1992 Lennox ..... A63B 21/078 482/104
5,232,426 A 8/1993 Van Straaten
5,324,247 A * 6/1994 Lepley ..... A63B 23/0233 482/112
5,370,595 A 12/1994 Voris et al.
5,437,236 A * 8/1995 Zeiner ..... A47B 9/10 108/147
5,447,480 A * 9/1995 Fulks ..... A63B 21/00072 482/100
5,601,519 A * 2/1997 Comereski ..... A63B 21/169 482/130
5,649,886 A 7/1997 Danylieko
5,743,832 A * 4/1998 Sands ..... A63B 22/001 482/112
5,795,271 A * 8/1998 Pearson ..... A63B 21/0087 482/111
5,840,001 A * 11/1998 Schedel ..... A61H 1/0218 482/130
6,264,586 B1 7/2001 Webber
6,475,127 B1 * 11/2002 Koenig ..... A63B 21/00047 482/104
6,536,058 B1 3/2003 Vrzalik et al.
6,595,588 B2 7/2003 Brightbill et al.
6,643,873 B2 11/2003 Heimbrock
6,645,130 B2 11/2003 Webber
6,659,923 B2 * 12/2003 Teuscher ..... A63B 21/00 482/142
6,689,027 B1 * 2/2004 Gardikis, Jr. ..... A63B 21/078 482/142
6,805,409 B2 10/2004 Parker
6,820,293 B2 11/2004 Alverson
6,839,926 B2 1/2005 Heimbrock et al.
6,894,661 B1 5/2005 Tuli
7,024,811 B1 4/2006 Cole
7,090,303 B2 8/2006 Kropa
7,294,097 B2 11/2007 Parker
7,331,912 B2 2/2008 Keiser et al.
7,426,760 B2 9/2008 Vrzalik
7,513,570 B2 4/2009 Roslund et al.
7,591,764 B2 * 9/2009 Zuckerman ..... A63B 69/10 482/130
7,597,656 B2 10/2009 Trees
7,604,583 B2 * 10/2009 Denisco ..... A61H 1/0244 482/142
7,779,494 B2 * 8/2010 Poulos ..... A61G 7/005 5/618
7,886,379 B2 2/2011 Benzo
7,922,630 B1 * 4/2011 Batca ..... A63B 21/154 482/100
7,944,208 B2 * 5/2011 Dutto ..... A61B 5/0555 324/307
8,012,072 B2 * 9/2011 Forcillo ..... A63B 21/0615 482/139
8,021,285 B2 * 9/2011 Kushnir ..... A63B 21/00069 482/120
8,069,514 B2 * 12/2011 Poulos ..... A61G 7/002 5/613
8,118,366 B2 2/2012 Matveev
8,151,812 B2 * 4/2012 Razon ..... A61H 3/04 135/66
8,249,714 B1 8/2012 Hartman et al.
8,336,140 B2 * 12/2012 Parson ..... A61G 5/006 5/611
8,403,352 B2 3/2013 Hunziker
8,550,967 B2 10/2013 Zuckerman
8,590,920 B2 11/2013 Masaki
8,616,828 B2 12/2013 Myers et al.
8,640,285 B2 2/2014 Heimbrock et al.
8,701,229 B2 * 4/2014 Lemire ..... A61G 7/005 5/510
8,801,638 B2 * 8/2014 Gierse ..... A61G 5/14 297/145
8,844,961 B2 9/2014 Hunziker
8,858,409 B2 10/2014 Trees
8,864,233 B2 * 10/2014 Wei ..... A47C 1/022 297/195.11
8,899,680 B2 * 12/2014 Meier ..... A47C 1/03255 297/300.5
9,125,785 B2 9/2015 Trees
9,126,571 B2 9/2015 Lemire et al.
9,128,474 B2 9/2015 Rawls-Meehan
9,149,126 B2 10/2015 Rawls-Meehan
9,248,337 B1 * 2/2016 Humphrey ..... A63B 21/1457
9,433,818 B2 * 9/2016 Kalleen ..... A63B 71/0054
2005/0181917 A1 * 8/2005 Dayal ..... A61H 1/0222 482/142
2006/0035769 A1 * 2/2006 Phillips ..... A61H 1/003 482/123
2006/0073944 A1 * 4/2006 Zuckerman ..... A63B 69/10 482/56
2006/0217240 A1 * 9/2006 White ..... A63B 21/068 482/72
2009/0137370 A1 * 5/2009 Kushnir ..... A63B 21/00069 482/120
2009/0203505 A1 * 8/2009 Kroll ..... A63B 21/078 482/104
2009/0289633 A1 * 11/2009 Dutto ..... A61B 5/0555 324/321
2010/0249495 A1 * 9/2010 Siradag ..... A47C 11/00 600/38
2011/0263389 A1 * 10/2011 Burgassi ..... A63B 23/0488 482/79
2013/0203569 A1 * 8/2013 Athis ..... A63B 21/0552 482/142
2014/0296042 A1 * 10/2014 Snyder ..... A63B 23/0205 482/112
2015/0224359 A1 * 8/2015 Kalleen ..... A63B 71/0054 482/104

* cited by examiner

EXERCISE BENCH WITH ENHANCEMENTS THAT ALLOW THE OBESE, ELDERLY, AND PHYSICALLY CHALLENGED TO PARTICIPATE IN EXERCISES PERFORMED ON A CONVENTIONAL EXERCISE BENCH

FIELD OF THE EMBODIMENTS

The field of the present invention and its embodiments relate to a conventional exercise bench used for physically demanding exercises that has been enhanced to accommodate elderly, obese, and otherwise physically challenged individuals. In particular, the enhancements include side cushion supports that provide stability while exercising, and mechanical means that assist the user to recline to a horizontal position and return to a sitting position.

BACKGROUND OF THE EMBODIMENTS

As the population ages, and the obesity problem continues to grow, there is an increasing need for exercise equipment that allows over weight and aging individuals to participate in exercise programs that will assist them to maintain muscle mass and/or lose weight. Exercise benches are an important component of any exercise program, but particularly for older and obese patients for whom lying on the floor or doing routines involving hand weights in the standing position is very difficult. There are many kinds of exercise benches described in the prior art. There are benches with adjustable positions from sitting to reclining. Oswald, et al, U.S. Pat. No. 5,060,939 describes a bench convertible from a chair-like configuration to a bench-like configuration. Van Straaten, U.S. Pat. No. 5,232,426, McBride, U.S. Pat. No. 6,030,324, Parker, U.S. Pat. No. 6,805,409 and U.S. Pat. No. 7,294,097, Kecala, U.S. Pat. No. 4,546,967, and others claim a bench in which both the seat portion and back portion can be adjusted to different angles. Dawson, U.S. Pat. No. 6,994,661 and others propose a configuration where the angle of the entire bench can be adjusted from a vertical to a horizontal position. Others claim special features to assist users, for example: Danylieko, U.S. Pat. No. 5,649,886 claims a bench with lateral indentations for improved spine support, Voris, et al, U.S. Pat. No. 5,370,595 claims a bench wherein the angle of the bench is independent of the horizontal position, and Keiser, et al, U.S. Pat. No. 7,331,912 claims a bench wherein the recline angle can be changed without changing the user's horizontal position. Others such as Weber, et al, U.S. Pat. No. 5,125,884 and Gardikis, U.S. Pat. No. 6,689,027 Include power assist for changing the position of all or a portion of the bench. Still others, for instance Jenkinson, U.S. Pat. No. 4,353,547, Wilson, U.S. Pat. No. 4,407,495, Roethke, U.S. Pat. No. 4,635,934, Cantor, U.S. Pat. No. 4,974,839, claim multi-functional benches used in conjunction with other equipment. However, none of these inventions are designed for use by obese, elderly, or physically challenged individuals who require extra assistance in changing positions, and stability when exercising.

Zuckerman, U.S. Pat. No. 8,550,967, describes a multiple use apparatus designed to duplicate exercise motions for swimming, biking, rowing, strength training and others. Similarly, Hartman, et al, U.S. Pat. No. 8,249,714 describes an apparatus specifically for an exercise for lower extremities in conjunction with electrical stimulation. Specialty equipment of these types do not represent prior art to the present invention which is designed to be used as a standard exercise bench, and not to replicate any particular sport or exercise.

There are also several pieces of home and hospital based furniture that provide stability and assist people in changing position, such as arm chairs that help people stand and mechanisms that allow people to sit up in bed, for example: Rawls-Meehan, U.S. Pat. Nos. 9,128,474, 9,149,126, Schermel, U.S. Pat. No. 8,616,828, Helmbrock, et al U.S. Pat. Nos. 8,640,285 and 6,839,926, and others describe a hospital bed with multiple actuators that re-position both the upper and lower body. Poulos, et al, U.S. Pat. Nos. 8,069,514, 7,779,494, and others describe a hospital bed with expandable mattress sections and restraint bladders for bariatric patients. The device of the current invention is novel over these and similar devices in that the individual using the exercise bench is providing at least some portion of the force required to re-position the bench. In addition, typical beds are not suitable for exercise, and therefore do not provide additional support or stability for elderly or obese people as they exercise.

Lemire, et al, U.S. Pat. Nos. 9,126,571 and 8,701,229, and Alverson, et al, U.S. Pat. No. 6,820,293 describe a hospital bed with patient support in the form of side rails and other barriers designed to prevent a patient from falling when the bed is moved around in a hospital. Benzo, at al, U.S. Pat. No. 7,886,379 describes a hospital bed incorporating a hammock structure that can cradle a patient for support and to improve blood circulation. Vrzalik, U.S. Pat. No. 7,426,760 describes a hospital bed with adjustable side rails for bariatric patients. The design and features incorporated in these and other prior art are not suitable for the type of exercise contemplated in the current invention, and therefore do not provide learning applicable to an adjustable exercise bench.

There are also adjustable examination or test beds that accommodate test equipment and provide support for the patient during testing. For example, Trees, U.S. Pat. Nos. 9,125,785, 8,858,409, and 7,597,656, and Heimbrock, et al, U.S. Pat. No. 6,643,873 describe an adjustable hospital or examination bed with adjustable back and leg positions, including a power or manually assisted gas spring. Support and stability for the patient are provided with a chest strap that maintains the patient's position during movement. Stasney, et al, U.S. Pat. No. 7,024,711 describes a sonography exam bed with multiple trap doors and prop up sections. The device of the current invention is not anticipated by any of art in that it is designed for individuals who may have somewhat limited stability, but are not otherwise confined or in need of support in the manner of a hospital or exam bed.

Meier, et al, U.S. Pat. No. 8,899,680 describes an office chair incorporating a gas cylinder designed to adjust the height of the chair seat to provide comfortable seating for individuals of different heights. Similarly, Razon describes a walker incorporating a gas cylinder to assist handicapped individuals in sitting and standing, and Matveev, U.S. Pat. No. 8,118,366 describes a gas cylinder that assists in changing the chair seat angle. Although Meier, Razon, and Matveev teach the use of a gas cylinder in conjunction with force applied by the user, the device of the current invention incorporates a novel application of gas cylinder technology not anticipated by its use with an office chair or a walker.

Wel, et al, U.S. Pat. No. 8,864,233, Roslund, et al, U.S. Pat. No. 7,513,570, Kropa, U.S. Pat. No. 7,090,303, and others teach chairs with adjustable back, seat, foot and arm rests designed for user comfort, and easy access. Brightbill, et al, U.S. Pat. No. 6,595,586 describes automotive seats with side supports to "cradle" the passenger. These technologies are widely known and applied in fields from dental offices to tattoo parlors. The device of the current invention is novel over this prior art in that it provides adjustable support to an exercise bench which otherwise has no such support, unlike adjustable chairs which do not require additional support, but also do not allow an individual using them to perform physical activities like those contemplated for users of an exercise bench.

Hunziker, U.S. Pat. No. 8,844,961, Gierse, U.S. Pat. No. 8,801,638, Masaki, U.S. Pat. No. 8,590,920, Parson, et al, U.S. Pat. No. 8,336,140, and others describe wheel chairs with novel means of assisting patients in standing or reclining. Adjustable wheel chairs and like devices that assist a patient in standing do not anticipate the device of the current invention, in that they are inherently stable and intended for handicapped individuals, not individuals who are otherwise mobile, but need support in using a standard exercise bench.

None of the prior art described above envision stabilizing an individual during both the reclining and sitting motion, and while the person is performing exercises in either position. Hence, there is still a need for an exercise bench with such refinements adapted for use by elderly, obese, and physically challenged individuals.

SUMMARY OF THE EMBODIMENTS

The objective of the current invention is to incorporate into an exercise bench means for the elderly, obese, and physically challenged individuals to use the bench for normal exercise activities by incorporating side support arms, as well as mechanical means to assist in reclining and returning to a sitting position.

In one embodiment, the side support arms are adjustable from a narrow position wherein the side support cushions are touching the upper cushions, to a position wherein the side support cushions are 12 inches away from the top cushions. In another embodiment, the position of the side support arms are adjustable in a longitudinal direction parallel to the main axis of the exercise bench in order to accommodate individuals of varying height. In yet another embodiment, the side support arms are comprised of a formed cushion adjustably attached to a side support bracket which is adjustably attached to the top cushion plate.

In another embodiment, the mechanical assistance for reclining and returning to a sitting position incorporates a gas cylinder. In a preferred embodiment, said exercise bench further comprises connection brackets related to the gas cylinder, and a mechanism that locks the reclining portion of the bench in the prone position during exercise and releases said reclining portion when the user desires to sit up.

In yet another embodiment, an exercise bench is described wherein mechanical means are incorporated that assist a person to recline a portion of the bench from an upright position to a reclined position parallel to the other bench portion and return it to an upright position, such that obese, elderly and handicapped people without sufficient abdominal strength can use said exercise bench unassisted, and without over exerting themselves. In a related embodiment, said mechanical means comprise a gas cylinder and associated brackets for attachment to the reclining portion of the bench and to the base plate. In another preferred embodiment of the current invention, the gas cylinder is adjustable between a setting that provides 20 pounds of force and other settings that provide up to 200 pounds of force when the top cushion plate is horizontal and parallel to the bottom cushion plate. More preferably said gas cylinder is adjustable between 30 and 150 pounds, and still more preferably between 30 and 100 pounds.

In yet another embodiment, the bench is comprised of a base plate with support legs, and top and bottom cushion plates attached to the base plate; said top cushion plate is adjustable from a prone position parallel to the bottom cushion plate to an upright position wherein said top cushion plate is perpendicular, or at an included angle of 90 degrees to said bottom cushion plate; more preferably at an included angle of 100 degrees to said bottom cushion plate, and most preferably at an included angle of 110 degrees to said bottom cushion plate.

In another embodiment of the current invention, the legs of the exercise bench are angled outward from the base plate an amount sufficient to prevent tilting of said exercise bench when an Individual weighing up to 300 pounds is using said bench, and the side cushions are extended laterally to their maximum position. In another preferred embodiment of the current invention, the length of the support legs is adjustable such that the height of the top surface of the bottom cushion from the floor is between 12" and 30", more preferably between 15" and 24".

DESCRIPTION OF THE PREFERRED EMBODIMENTS

Definitions

As used herein, the term exercise means an activity requiring physical effort involving movement with or without the addition of heavy objects.

As used herein, the term exercise bench means a flat or inclined surface on four legs, and in one or more sections on which an individual can exercise.

As used herein, the term gas cylinder means a cylinder with an internal piston and actuator rod connected to the piston. The cylinder contains a compressible fluid that is compressed when pressure is applied to the actuator rod and piston. When the pressure is released, the compressible fluid applies a counter force to the piston and actuator rod, and thereby to any structure attached to them.

As used herein, the term cushion means a soft object or part used to make something such as a seat or bed more comfortable.

As used herein, the term pounds of force means the force applied by the gas cylinder when it is fully compressed. Since weight is a measure of the force applied by gravity to an object, the force applied by the gas cylinder will balance an object with an equivalent weight. For example, 50 pounds of force applied by the gas cylinder will counterbalance 50 pounds or an individual's weight, thereby reducing by 50 pounds the weight that must be overcome by an exercise bench user's abdominal muscles when reclining or sitting.

Figure 1:
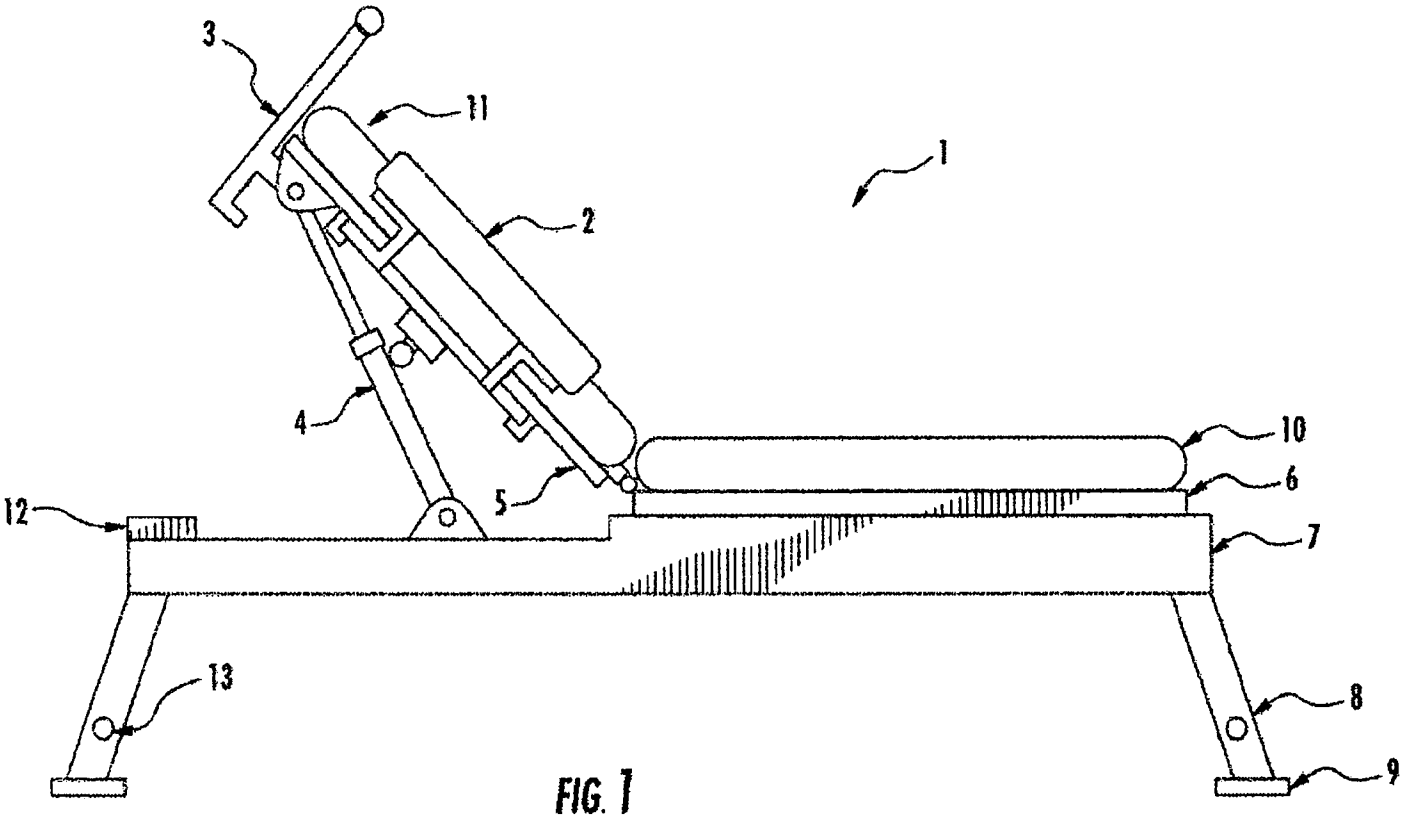
FIG. 1 is a side elevation view of the exercise bench of the current invention including all of the ancillary assemblies.

Referring now to FIG. 1, a side elevation view of the entire adjustable exercise bench, 1, is shown, including its component assemblies: the side support assembly, 2, the recline lock assembly, 3, and the rise/recline assist assembly, 4. It also identifies some of the individual components, such as the top and bottom cushion plates, 5 and 6, the base plate, 7, the legs, 8, the feet, 9, the bottom cushion, 10, the top cushion, 11, the recline stop, 12, and the leg height adjust pin, 13. It illustrates the main features of the current invention, namely the side support arms that provide stability for the individual during exercise and the mechanical means incorporated to assist the user in reclining to a prone position and returning to an upright, sitting position.

Figure 2:
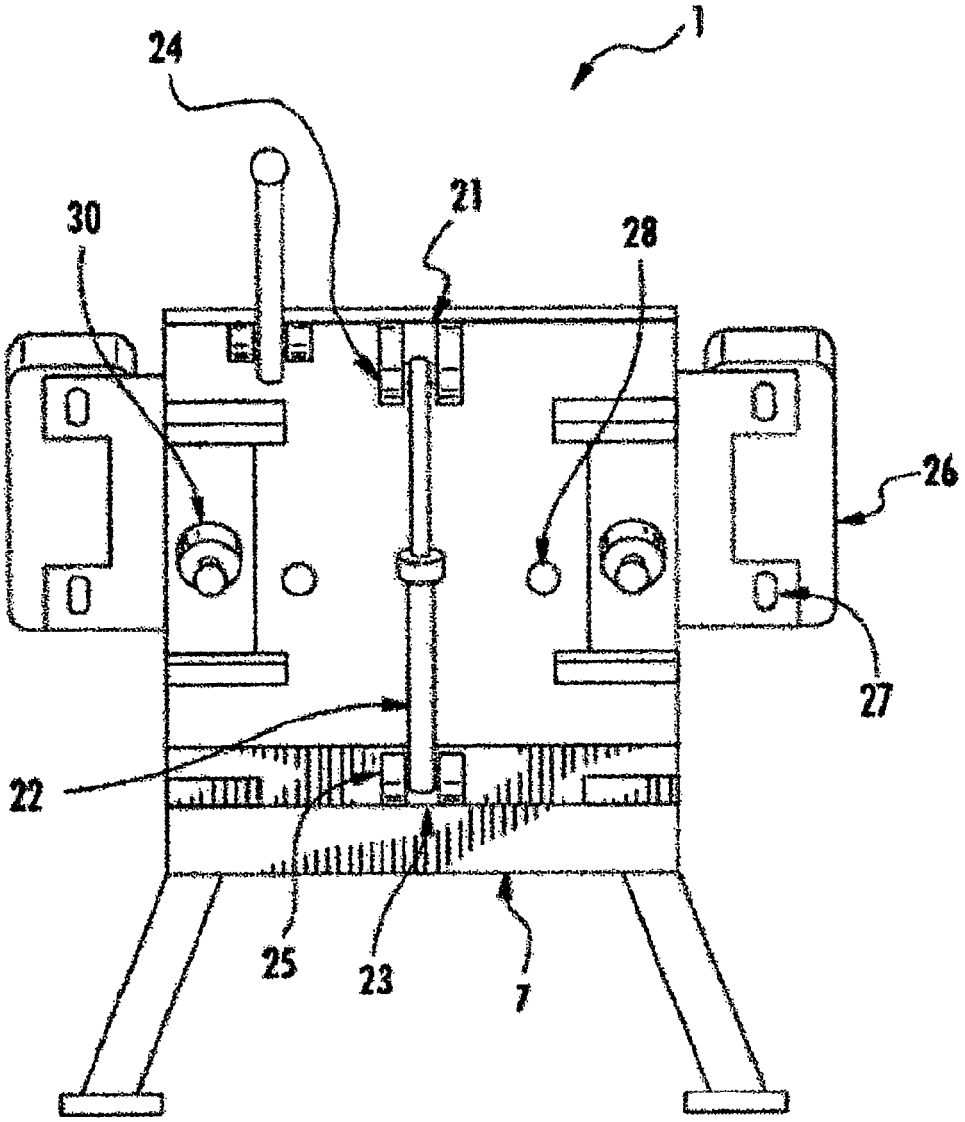
FIG. 2 is a rear elevation of the bench.

FIG. 2 is an elevation view from the rear of the adjustable bench assembly, 1, including, the side support cushions, 26, the longitudinal side support adjustment holes, 27, the vertical side support adjustment holes, 28, and the side support pin assembly, 30. The lateral side support holes allow the position of the side support cushions to be adjusted from a position where they are touching the top cushions, 11, to a position where they are separated from the top cushions by 12 inches in order to accommodate obese individuals. The vertical side support adjustment holes allow the side support cushions to be adjusted in a direction parallel to the main axis of the bench, to accommodate individuals of varying heights. Also identified are the components of the rise/recline assist assembly including, the two yokes, 21 and 23, the two pins, 24 and 25, that attach the rise/recline assist assembly to the top cushion plate, the base plate, 7, and the gas cylinder, 22, which provides the individual with assistance in lying down or sitting up on the exercise bench. The assistance force provided by the gas cylinder when the user is in the prone position can be varied from 20 to 200 pounds; more preferably 30 to 150 pounds; most preferably 30 to 100 pounds.

Figure 3:
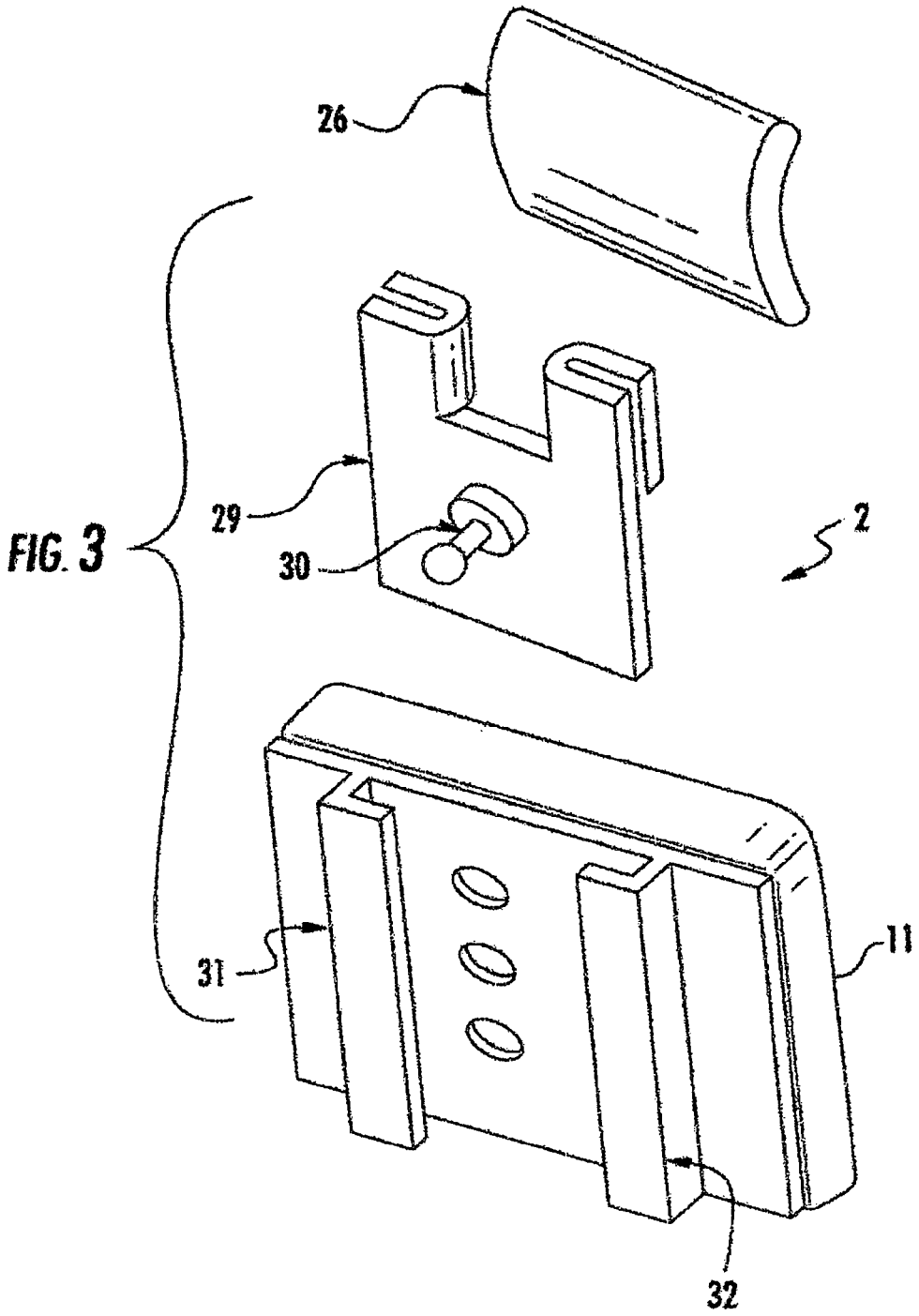
FIG. 3 is an exploded view of the side support assembly, 2.

FIG. 3 is an exploded view that provides detail of the side support assembly, 2, and includes the side support adjustment plate, 29, the side support pin assembly, 30, the side support brackets. 31 and 32, and the side support cushions, 26. This assembly is designed to adjust the side support cushions laterally to accommodate individuals of varying body types.

Figure 4:
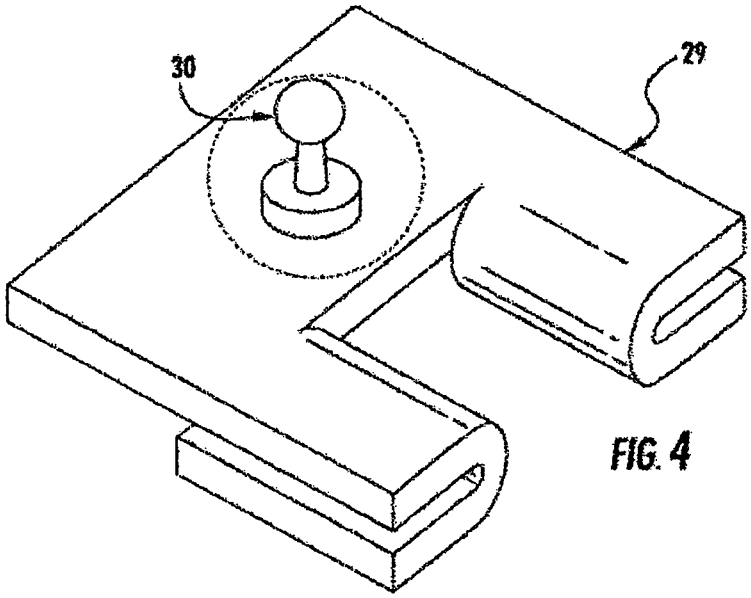
FIG. 4 is an isometric view of the side support assembly, 2.
Figure 5:
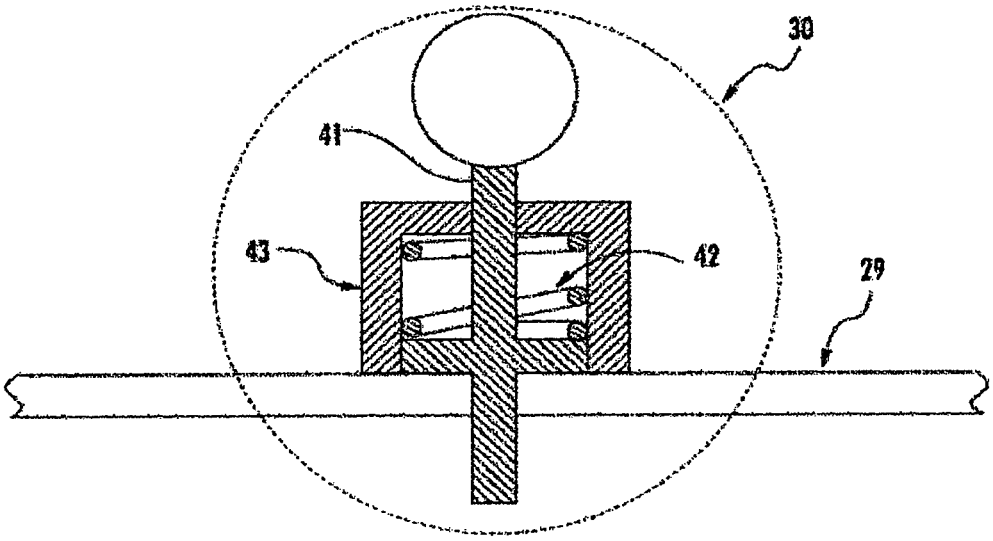
FIG. 5 is a side, cross sectional view of the side support pin assembly, 30.

FIGS. 4 and 5 detail the side support pin assembly, 30, and its components: the side support pin, 41, the compression spring, 42, and the spring housing, 43. It also illustrates the position of the side support pin assembly on the side support adjustment plate, 29.

Figure 6:
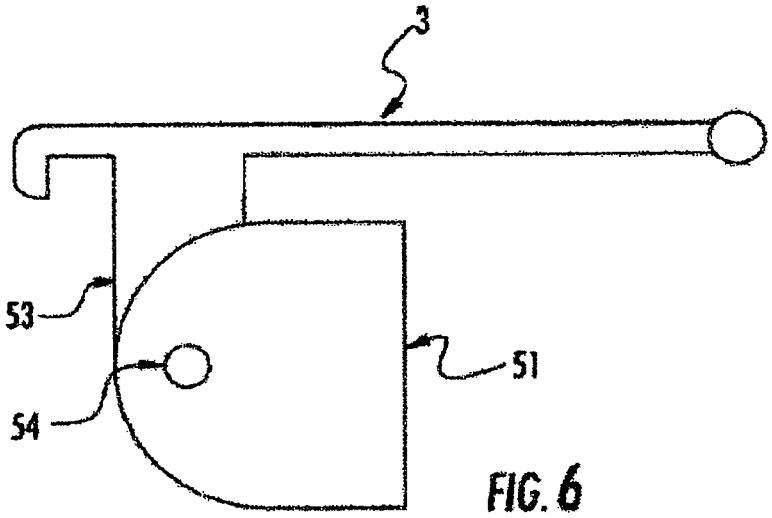
FIG. 6 is a side view of the recline lock assembly, 3.
Figure 7:
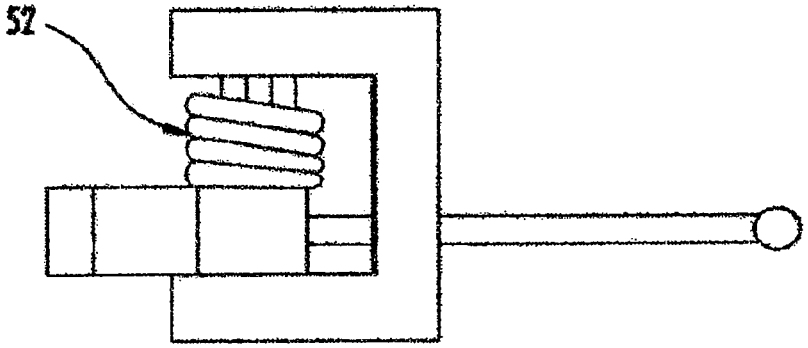
FIG. 7 is a rear view of the recline lock assembly, 3.

FIGS. 6 and 7 illustrate the recline lock assembly, 3, and its components: the yoke. 51, the torsion spring, 52, the recline lock handle, 53, and the pivot pin, 54. As the individual reclines to the prone position, the recline lock handle engages the base plate, 7, to resist the force applied by the gas cylinder, 4, and maintain the top cushion plate, 5, in the horizontal position. The handle is actuated to release the top cushion plate, 5, thereby allowing the rise/recline assist assembly to assist the individual to sit up on the bench.

What is claimed:

1. An exercise bench comprising:

a base plate and four attached legs;

top and bottom cushion plates wherein said top cushion plate is adjustable from a prone position parallel to said bottom cushion plate, to an upright position perpendicular to said bottom cushion plate;

top and bottom cushions attached to said top and bottom cushion plates; and side support assemblies adjustably attached to said top cushion plate that engage and stabilize the sides of users with varying body types without interfering with said users range of arm motion while exercising, and that are comprised of side support cushions, side support adjustment plates, side support brackets, and side support pins; wherein said side support adjustment plates and said side support cushions are laterally extensible from a narrow position wherein said side support cushions are touching said top cushion, to a wide position wherein said side support cushions are up to 12 inches away from said top cushion.

2. The exercise bench of claim 1 wherein said side support cushions are adjustably attached to said side support adjustment plates such that individuals of varying height can use said exercise bench.

3. An exercise bench comprising:

a base plate and four attached legs;

top and bottom cushion plates wherein said top cushion plate is adjustable from a prone position parallel to said bottom cushion plate to an upright position perpendicular to said bottom cushion plate;

top and bottom cushions attached to said top and bottom cushion plates;

side support assemblies adjustably attached to said top cushion plate that engage and stabilize the sides of users with varying body types without interfering with said users range of arm motion while exercising; and that are comprised of side support cushions, side support adjustment plates, side support brackets, and side support pins; and a rise/recline assist assembly comprised of a gas cylinder, two yokes, and two pins attached to said base plate and said top cushion plate that reduces the amount of body weight that must be overcome by the abdominal muscles of users of said exercise bench by causing said top cushion plate to adjust from a prone position parallel to said bottom cushion plate to an upright position perpendicular to said bottom cushion plate, such that said users can recline slowly to a prone position and return to a sitting position after exercising without assistance from other individuals.

4. The exercise bench of claim 3 wherein the force applied by said gas cylinder is adjustable between a minimum setting that provides 30 pounds of force, and a maximum setting that provides up to 200 pounds of force when said top cushion plate is horizontal and parallel to said bottom cushion plate.

5. The exercise bench of claim 3 wherein said four attached legs are angled outward from said base plate an amount sufficient to prevent tilting of said exercise bench when an individual weighing up to 300 pounds is using said exercise bench, and said side support assemblies are extended to a position where said side support cushions are 12" from said top cushion.

6. The exercise bench of claim 3 wherein said four attached legs are adjustable such that the height of the top surface of the bottom cushion from the floor is between 12" and 30".

7. The exercise bench of claim 3 further comprising a recline lock assembly comprised of a recline lock handle, and associated yoke and torsion spring, whereby the user of said exercise bench can release said rise/recline assist assembly while in the reclined position in order to return to a sitting position without assistance.

* * * * *